United States Patent [19]

Kania

[11] Patent Number: 4,458,636

[45] Date of Patent: Jul. 10, 1984

[54] METHOD TO REDUCE NOISE IN THE OPERATION OF PORT-CONTROLLED, TWO-STROKE INTERNAL COMBUSTION ENGINE, PARTICULARLY

[75] Inventor: Norbert Kania, Laatzen, Fed. Rep. of Germany

[73] Assignee: Sachs-Dolmar GmbH, Hamburg, Fed. Rep. of Germany

[21] Appl. No.: 334,537

[22] Filed: Dec. 28, 1981

[30] Foreign Application Priority Data

Jan. 14, 1981 [DE] Fed. Rep. of Germany ..... 3100851

[51] Int. Cl.[3] ..... F02B 33/04; F02B 25/14

[52] U.S. Cl. ..... 123/73 R; 123/65 P; 123/65 PE; 123/73 V; 123/73 A

[58] Field of Search ..... 123/65 P, 65 PE, 73 A, 123/73 V, 73 R

[56] References Cited

U.S. PATENT DOCUMENTS 960,797 6/1910 Blair ..... 123/73 A
3,945,354 3/1976 Johnston ..... 123/65 P

FOREIGN PATENT DOCUMENTS 316922 4/1918 Fed. Rep. of Germany .... 123/65 P
13824 2/1979 Japan ..... 123/65 PE

*Primary Examiner*—Wendell E. Burns
*Attorney, Agent, or Firm*—Toren, McGeady and Stanger

[57] ABSTRACT

The invention relates to a method and to a port-controlled two-stroke internal combustion engine in which the cross-sections of the intake and outlet are so constructed in the direction of the longitudinal axis of the cylinder that in the case of an upward or downward movement of the piston, the noise-generating intake and outlet pressure gradients and amplitudes are reduced by the gradual opening of the particular intake and outlet, the piston lower edge and intakes having special constructions.

4 Claims, 32 Drawing Figures

Figure 1:
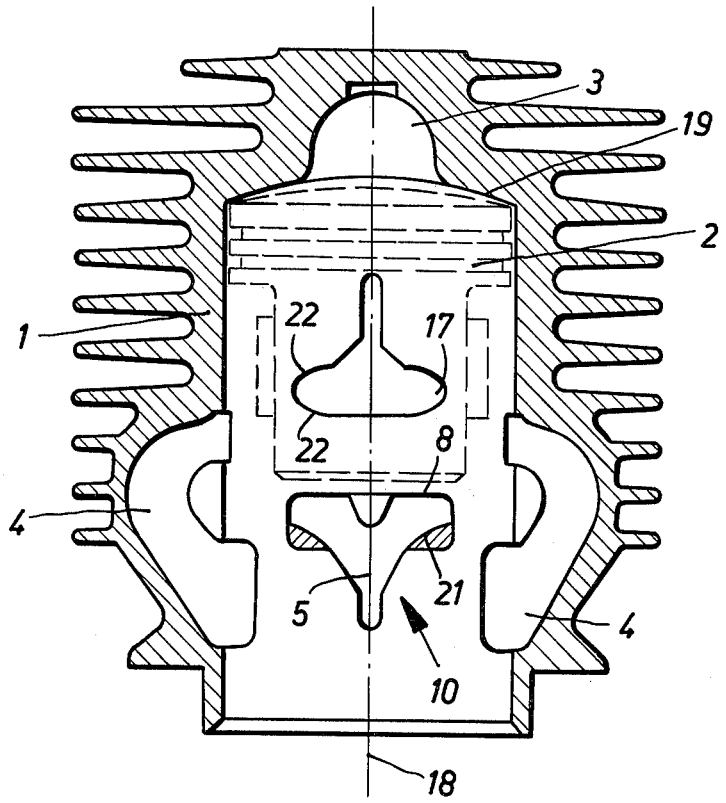

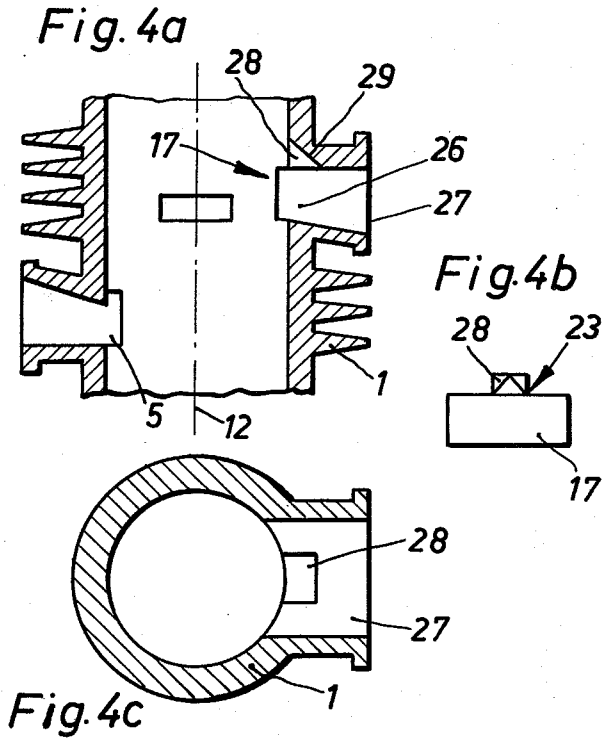
Fig.4a
Fig.4b
Fig.4c
1
5
12
17
23
26
27
28
29
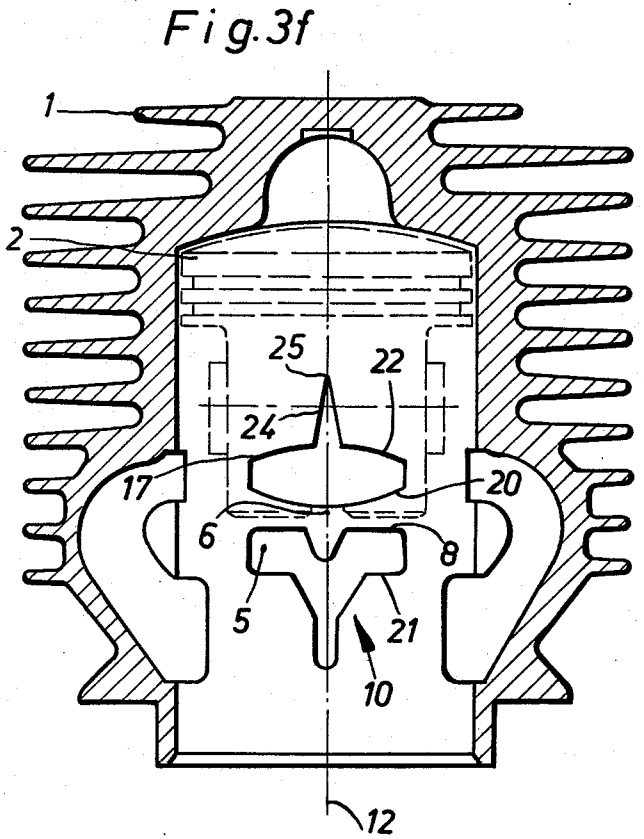
Fig.3f
1
2
5
6
8
10
12
17
20
21
22
24
25

Fig.5a
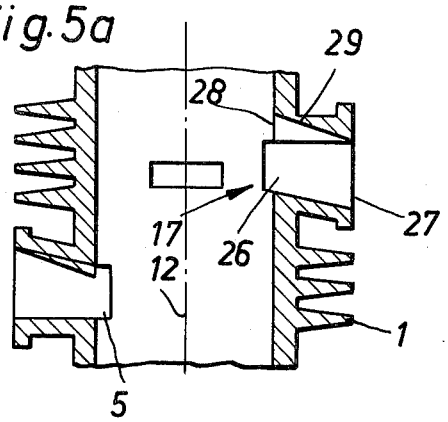
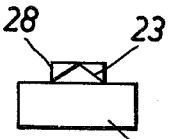
Fig.5b
Fig.5c
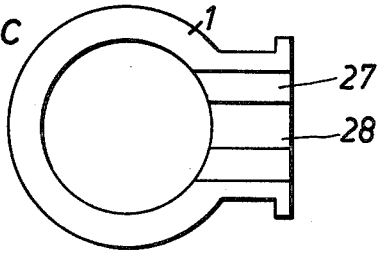
Fig.6a
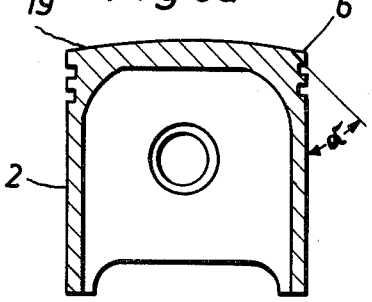
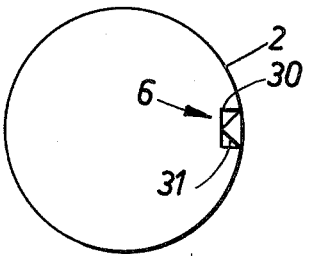
Fig.6b
Fig.7a
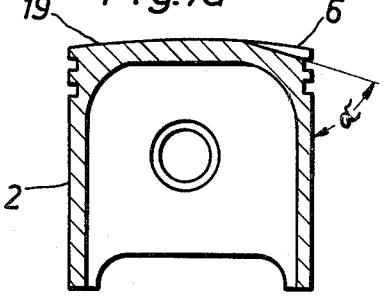
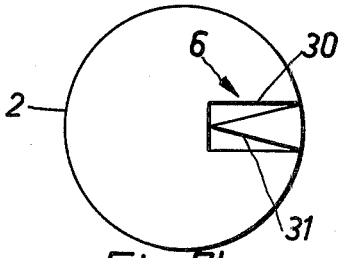
Fig.7b

METHOD TO REDUCE NOISE IN THE OPERATION OF PORT-CONTROLLED, TWO-STROKE INTERNAL COMBUSTION ENGINE, PARTICULARLY

The invention relates to a method for reducing noise in the operation of port-controlled, two-stroke internal combustion engines, particularly for chain saws by constructing the ports with opening cross-sections varying in the direction of the piston stroke, as well as a port-controlled two-stroke internal combustion engine with a cylinder supplied via a scavenging air supply line having an intake and outlet with profile portions extending substantially at right angles to the longitudinal axis of the cylinder for performing the said method.

In such internal combustion engines known e.g. from DAS No. 2,624,249, attempts have already been made by varying the outlet geometry to reduce the idling noise of the engine. In connection therewith, in addition to the conventional outlet, additional auxiliary outlets have been provided and the latter and the main outlet have been arranged in such a way that they satisfy specific mathematical conditions. However, the known construction with respect to the outlet geometry has not proved satisfactory for reducing noise because in the case of chain saws with two-stroke internal combustion engines of the aforementioned type, noise is mainly produced under full load and when idling when the engine operates at full speed, but without load application.

The problem of the invention is to so construct a port-controlled two-stroke internal combustion engine of the aforementioned type that the full load and idling noise levels are reduced for an unchanged engine power.

According to the invention, this problem is solved in that in the case of a symmetrical control diagram the opening and closing processes in the vicinity of the intake and outlet are gradually modified by the forward shifting of the opening time and the backward shifting of the closing time of the in each case free passage cross-section of the intake and outlet as a function of the piston movement, so that the periodic opening and closing processes are extended in time.

According to another feature of the invention, the internal combustion engine for performing the method has opening cross-sections of the intake and outlet in the direction of the longitudinal axis of the cylinder such that during the upward and downward movement of the piston the noise-generating intake and outlet pressure gradients and amplitudes are reduced by the gradual opening of the particular intake and outlet.

The other features of the invention are described in the subclaims and are illustrated hereinafter with respect to embodiments of the intake and outlet geometries in connection with an internal combustion engine and the attached drawings, wherein show:

FIG. 1 a two-stroke cylinder with the intake and outlet constructed in accordance with the invention in a view of the inside of the cylinder from the intake and outlet.

Figure 2:
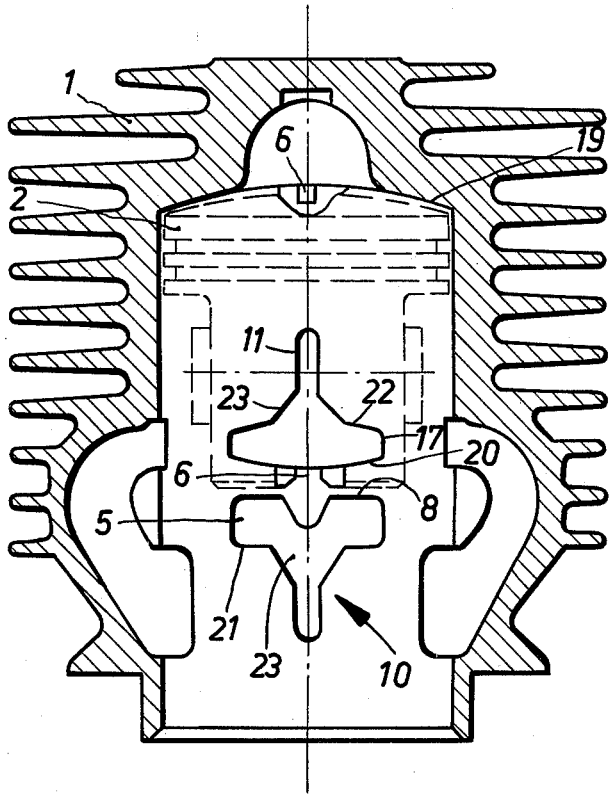

FIG. 2 a two-stroke cylinder with an intake and outlet geometry, modified with comparison to that of FIG. 1 and with a piston having recesses adapted thereto.

FIGS. 3 to 3*f* further examples of intake and outlet modifications with recesses on the piston edges adapted to the particular port in a view of the inner jacket of the cylinder from the intake and outlet sides.

FIGS. 4*a* to 4*c* an embodiment of the cylinder outlet in a side view, plan view and transverse view in cross-section.

FIGS. 5*a* to 5*c* a further embodiment of a cylinder outlet in side view, plan view and transverse view in cross-section.

FIGS. 6*a* and 6*b* an embodiment of the piston bottom with a V-shaped bevel facing the outlet.

FIGS. 7*a* to 7*b* further embodiment of a piston bottom with a V-shaped bevel facing the outlet.

FIGS. 8*a* to 8*i*, 8*k* and 8*l* possible intake and outlet modifications with possible piston upper and lower edges in a diagrammatic view.

Figure 9:
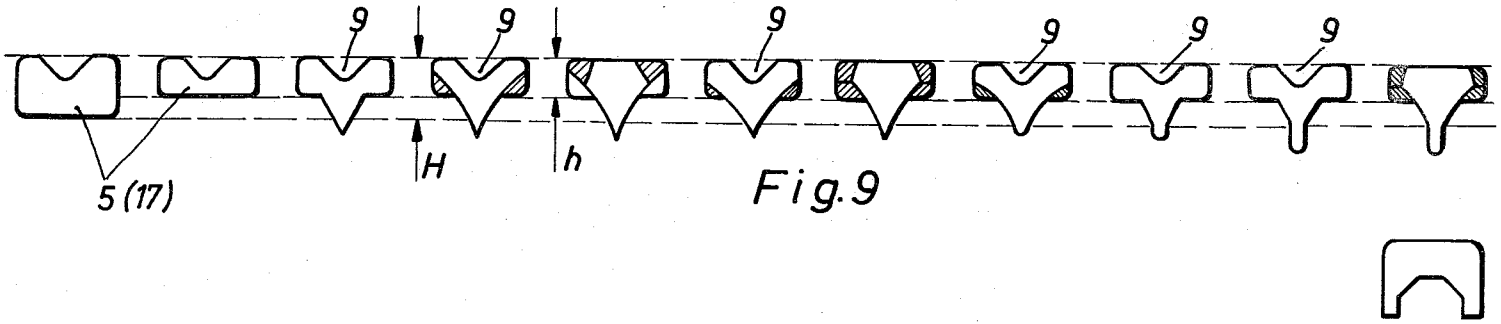

FIG. 9 a plurality of different intake and outlet modifications in a diagrammatic view.

Figure 10:
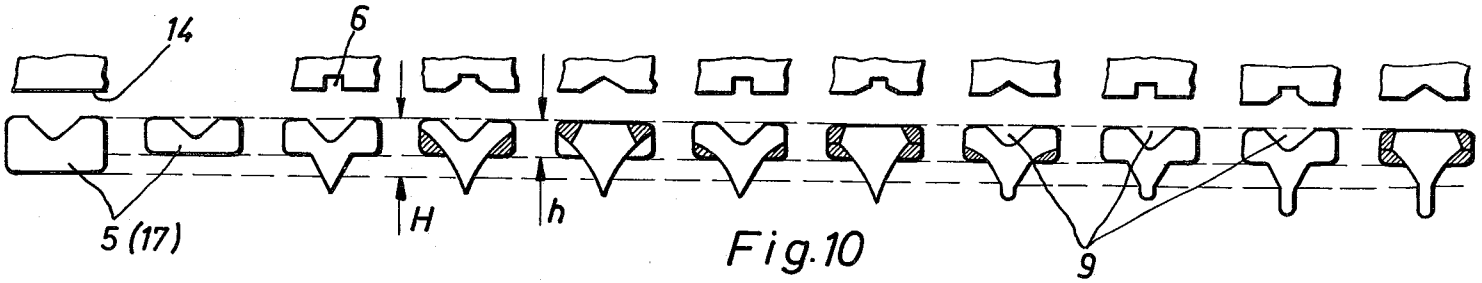

FIG. 10 the port modification of FIG. 9 with piston portions associated with the ports in a diagrammatic view.

Figure 11:
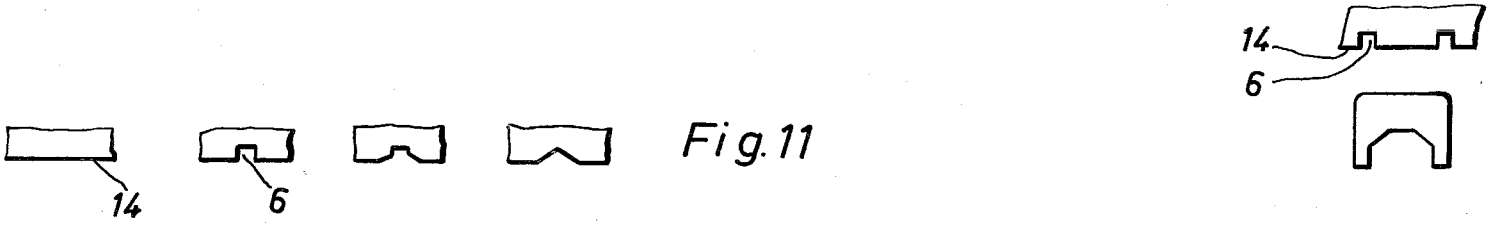

FIG. 11 possible embodiments of the piston portions to be associated with the intake and outlet.

Figure 12:
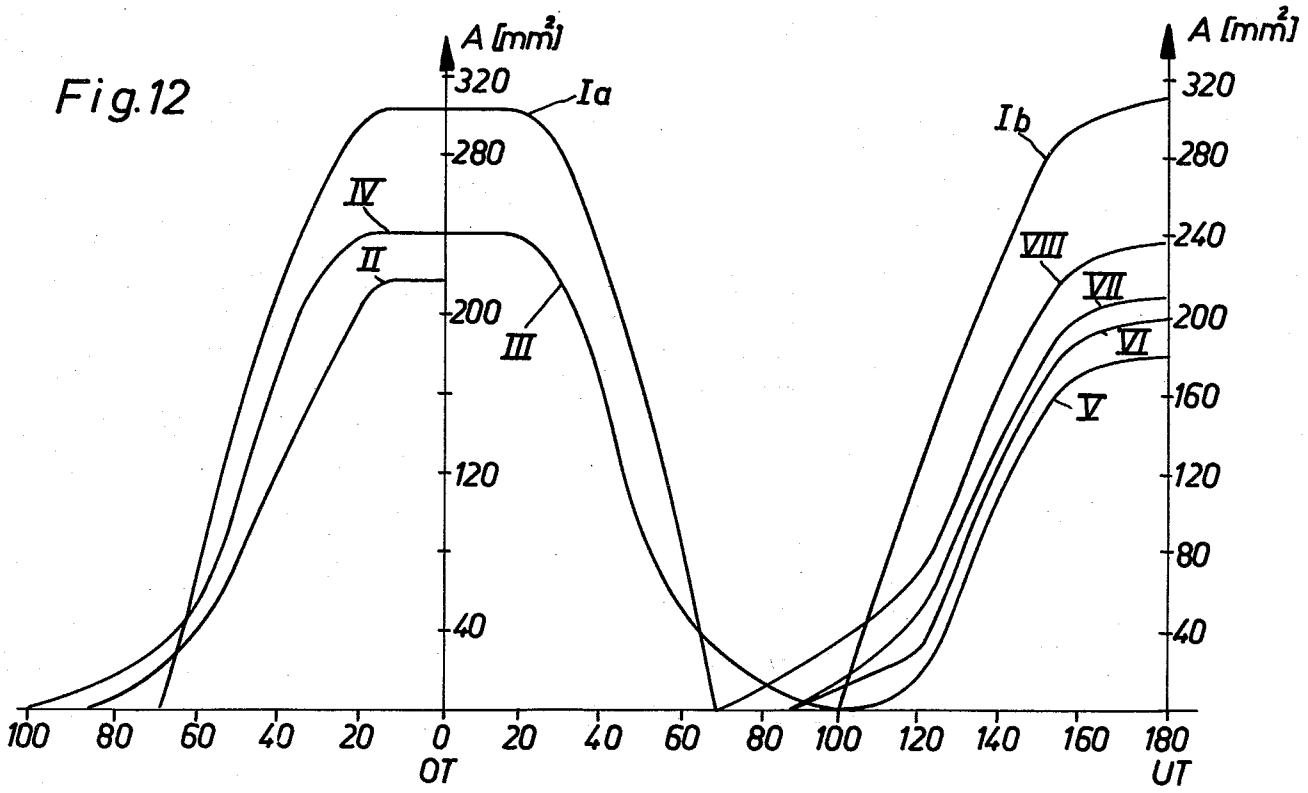

FIG. 12 intake and outlet control diagrams when using different intake and outlet geometries compared with a known, mass-produced port construction.

FIGS. 1 and 2 in each case show a cylinder 1 of a two-stroke internal combustion engine in longitudinal section and which is normally mounted on the top of a crankcase. The intake and outlet are placed in one sectional plane to make completely clear their associated configurations. Piston 2, which is only shown in dotted line form, works within cylinder 1 and during its upward and downward stroke, passes over intake 5, outlet 17 and scavenging passages 4. A combustion chamber 3 is provided in the head of cylinder 1. In the embodiment of FIG. 2, cylinder 1 contains an intake 5 and an outlet 17 with a different geometry to that of cylinder 1 of FIG. 1. Intake 5 and outlet 17 are in both embodiments constructed homologously to one another about a perpendicular with respect to the longitudinal axis 18 of the cylinder.

On the piston lower edge 14 and piston upper edge 19 recesses 6 are provided in connection with piston 2 of cylinder 1 according to FIG. 2 and one recess cooperates with intake 5 and the other with outlet 17. Recesses 6 can be constructed in the vicinity of the transitions of the transfer ports, e.g. as a bevel on the particular piston edge or as grooves with flattened bottoms, which leads to a favourable flow guidance of the gaseous mixture entering and leaving the cylinder.

Figure 3B:
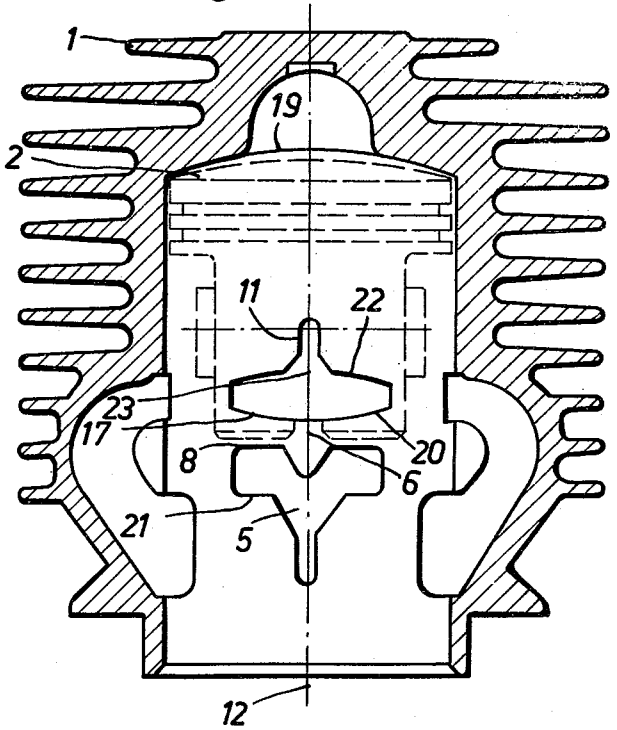
Figure 3A:
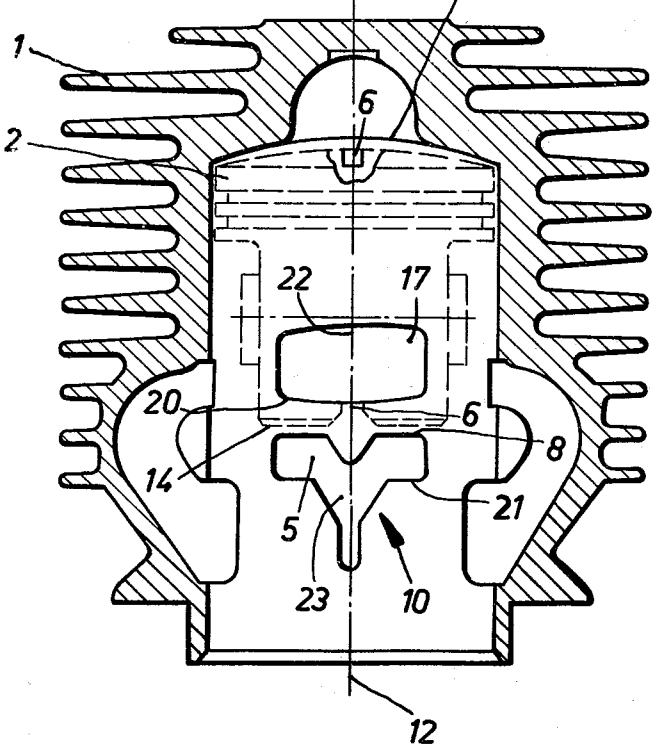

FIGS. 3*a* and 3*f* show different embodiments of the geometries or constructions of the intakes and outlets or possible constructions of recesses 6 on the lower edge 14 and upper edge 19 of the piston.

In cylinder 1 of FIG. 3*a*, intake 5 is constructed in a similar manner to that of FIG. 2. On the lower edge 14 of piston 2 there is a recess 6, which is somewhat covered by the lower edge 20 of outlet 17. A recess 6 in the form of a groove is provided on piston upper edge 19 and can have a rectangular or triangular cross-section. In per se known manner, outlet 17 generally has a rectangular construction with a convex lower edge 20 and upper edge 22.

In the case of cylinder 1 of FIG. 3*b*, there is no recess on the piston upper edge 19, unlike in the case of FIG. 3*a*. Outlet 17 has reduced height H, but is centrally provided with an elongated slot 11 extending toward the cylinder head parallel to the longitudinal axis 18 of the cylinder and which follows onto the enlargement 23 formed at the upper boundary 22. Intake 5 and recess 6 formed on piston lower edge 14 correspond to the construction of FIG. 3*a*.

Figure 3D:
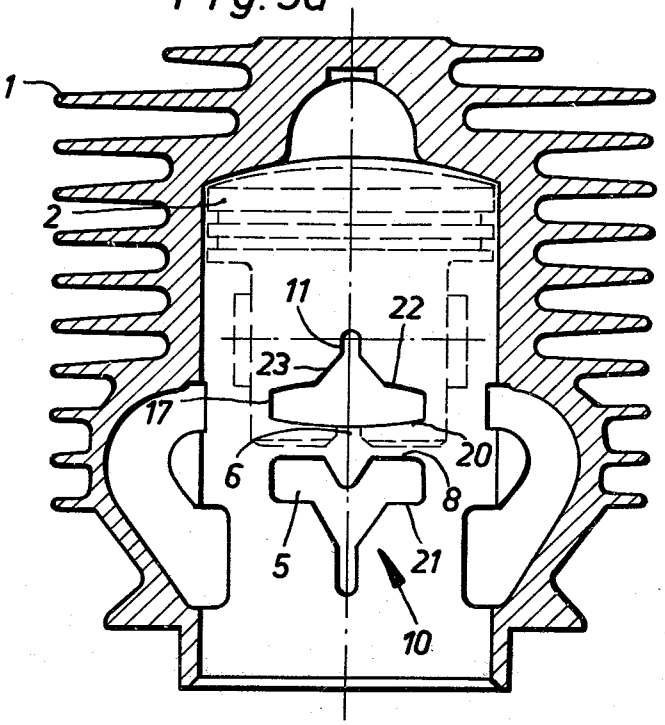
Figure 3C:
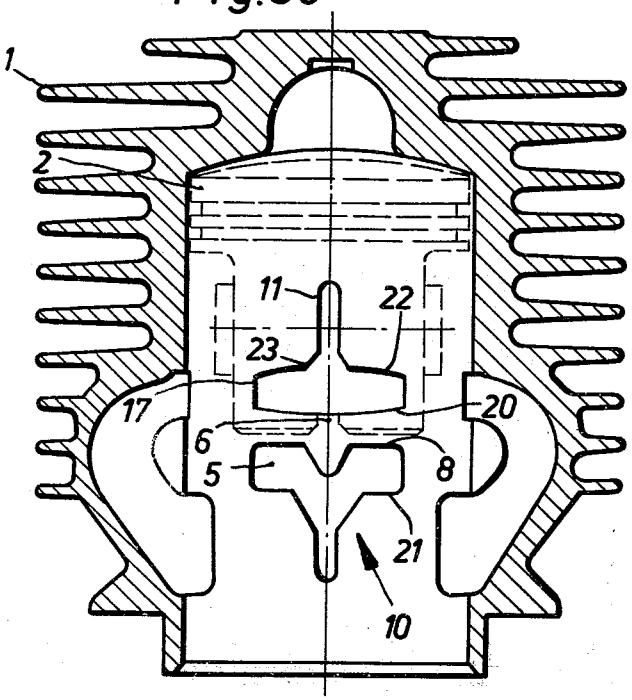
Figure 3E:
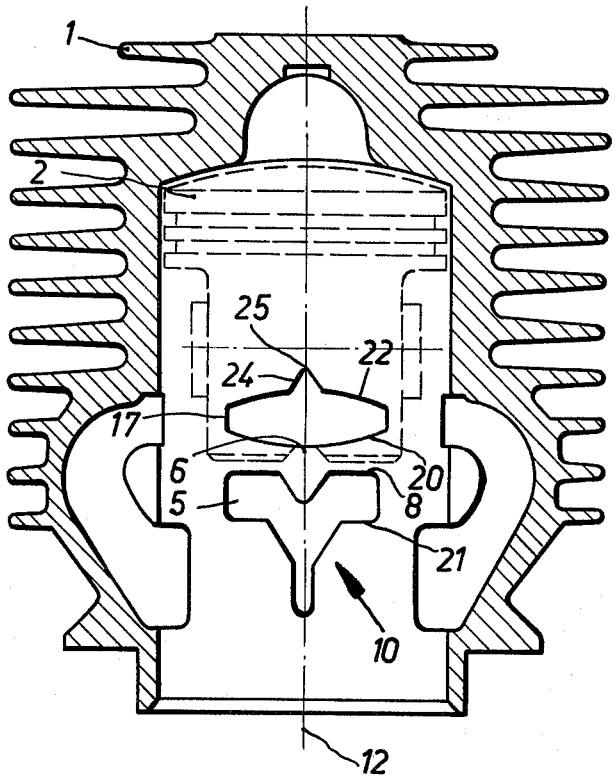

As shown in FIGS. 3*c* to 3*e*, the elongated slot 11 can be constructed with different lengths and widths. It is also possible to provide a cross-sectionally V-shaped enlargement 23 between the actual outlet 17 and elongated slot 11. The free cross-sectional surface of enlargement 23 can be adapted to the characteristics of cylinder 1.

The elongated slot 11 can be replaced by a triangular extension 24 to outlet 17, which has its tip 25 directed towards the cylinder head and runs parallel to longitudinal axis 18 of the cylinder. Extension 24 can be of different length (FIGS. 3*e* and 3*f*), so that the start of opening can be varied.

As shown in FIGS. 4*a* to 5*c* the elongated slots 11 or triangular extensions 23 in outlet passage portion 26 facing the inner area of the cylinder form a channel extension 28 passing into outlet channel 27. As a function of the slope of bottom surface 29, channel extension 28 can project to a varying depth in outlet channel 27.

Recesses 6 on piston upper edge 19 can be constructed as a keyway 30 with a rectangular cross-section and as a keyway 31 with a V-shaped cross-section (FIGS. 6*a* to 7*b*). It is also possible to choose a different cross-sectional shape, such as e.g. a semicircular shape or the like. Through the choice of the corresponding phase angle, which can be e.g. 45° to 80°, varyingly long recesses 6 can be obtained.

It is also possible to associate with intake 5 and outlet 17 appropriately constructed lower edges 14 and upper edges 19 of the piston. FIGS. 8*a* and 8*b* in each case show the configuration of a conventional intake 5 and outlet 17 compared with possible inventive modifications of intakes 5 (FIGS. 8*i* to 8*l*) and outlet (FIGS. 8*c* to 8*h*) with corresponding piston lower edges 14 or upper edges 19. As a function of the characteristics of the two-stroke internal combustion engine, the different modifications, including lower edges 14 and upper edges 19 are combined with one another.

Further modifications of intakes 5 and piston lower edges 14 are shown in FIGS. 9 to 11. The known port construction of height H is used as a basis. By raising the lower edge of intake 5 or lowering the upper edge for outlet 17, firstly height H is reduced to h and only then is the extension in the direction of the longitudinal axis 18 of the cylinder performed from the now higher lower edge of the now lower upper edge. As shown in FIG. 10, recesses 6 on piston lower edge 14 or piston upper edge 19 can be associated with the particular inventive port geometries. In certain cases, it can also be advantageous to drop the widened portion 10 and obtain the noise-reducing action mainly through a corresponding construction and arrangement of recesses 6 in lower edge 14 and upper edge 19. Through this possibility of varying the features of the combination according to the invention, it is possible to take account of the different conditions existing on the internal combustion engines with respect to the thermal and kinematic characteristics of the piston.

The geometries according to FIGS. 9 to 11 can also be used for outlet 17 or piston lower edges 19 by merely tilting the port surface by 180° about a horizontal line and by constructing recess 6 on piston upper edge 19. It is clear that the port modification according to the invention permits numerous geometrical combinations for the intakes and outlets 5, 17. The piston ring diverging projection 9 is only provided for intakes 5.

FIG. 12 shows intake and outlet control diagrams for different port configurations.

Fundamentally, the following sequences apply with respect to intake 5 and outlet 17 when operating the two-stroke internal combustion engine. During the upward movement of piston 2, it frees by means of its lower edge the lower intake edge 21 and in the upper dead centre reaches the upper boundary 8 and passes over the entire port height H. The process is the same in the vicinity of outlet 17. During the downward movement of piston 2, its upper edge 19 frees the upper boundary 22 from outlet 17 and after passing over the entire port height H reaches the lower boundary 20 in the lower dead centre. The control diagrams obtained when using the hitherto conventional mass-produced constructions of intakes 5 and outlet 17 (FIGS. 8*a*, 8*b*) are illustrated by the course of curves Ia, Ib in FIG. 12 according to which the opening and closing time is in each case at a crank angle of 67.5° after upper dead centre for intake 5 and 102° after upper dead centre for outlet 17. Curves Ia and Ib show the passed-over port area during the piston stroke with respect to time, expressed in crank angle degrees. The trace of the curve provides very high full levels through the area surrounded by the curves and as a result of the rapid rise and fall sudden opening and closing of the port can be expected, which leads to increased noise. According to the invention, this is avoided by modifying the port geometry, as is shown by curves II to VIII. The gradients of the opening and closing course $dA/d\phi$ are considerably reduced, which leads to a reduction of the noise-generating intake and outlet pressure gradients.

Curve II is based on an intake 5 as shown in FIG. 8*i*. The lower boundary 21 is displaced to level 7'. This area contains the port transition 23, which has a V-shape and passes into an elongated slot 11. The slot corners are filled by fillings 12, so that there is a gradual smooth path of the lower port boundary 21 or upper port boundary 22 on passing into the lateral limits. Curve II shows that, compared with the known port of FIG. 8*a*, there is an earlier opening at a crank angle of 87° before upper dead centre and correspondingly a later closing. There is a gradual rise and fall of the curve. The filling level is reduced, but the resulting power losses are only about $\geqq 5\%$ or of the same order of magnitude as the measuring precision of the test stand and are therefore negligible, particularly in connection with the operation of chain saws.

In the port embodiment of FIG. 8*k*, fillings 12 are removed, whilst the elongated slot 11 provided in FIG. 8*i* is lengthened. A recess 6, facing elongated slot 11, is provided on piston lower edge 14 and the not shown piston upper edge 19. A control diagram according to curve III is obtained with this port geometry in conjunction with the represented embodiment of the piston lower edge 14. Thus, this relates to intake 5. Curve III shows that a larger filling is obtainable compared with the port embodiment leading to curve II, accompanied by an earlier opening and/or closing.

Figure 8:
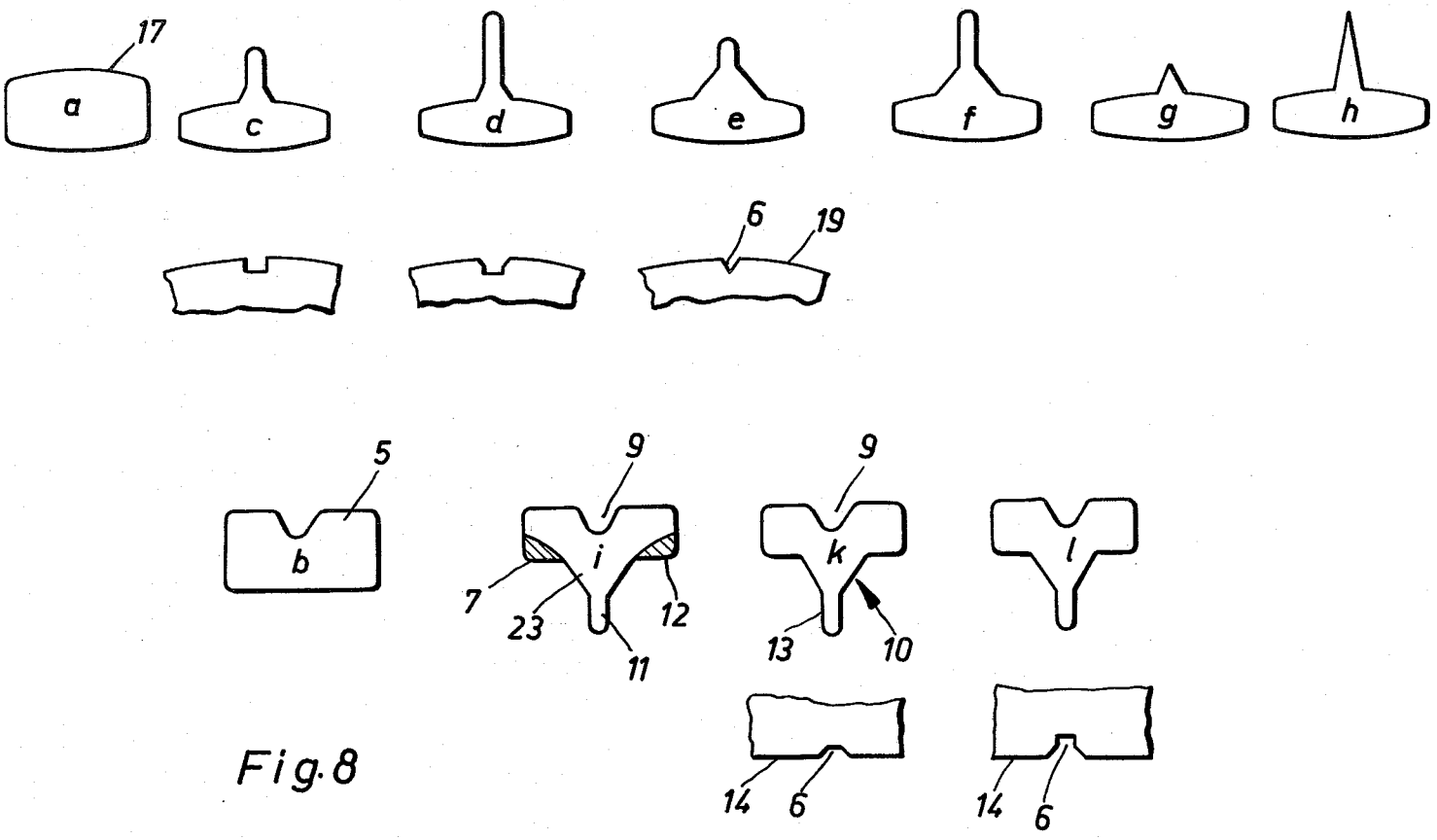

In the case of the port configuration of FIG. 8*l* with a piston lower edge 14, with a port geometry roughly corresponding to that of FIG. 8 is associated a recess 6 on piston lower edge 14 and which has an enlargement 16 of recess 6 in lower edge 14 compared with the embodiment of FIG. 8*k*. Curve 4 in FIG. 12 relates to the intake-side area of the port geometry and the piston lower edge construction and this reveals an extremely early opening at a crank angle of 102° before upper dead centre.

The outlet control-side curves V to VIII correspond to the outlets according to FIGS. 8*g*, 8*h*, 8*c*, 8*f*. Curve 5 is based on an opening point at 102.5°, curve VII an opening point at 87.5° and curve VIII an opening point of 70°, in each case crank angle after upper dead centre.

Control time diagrams V to VIII are fundamentally the same as the already discussed curves II to III. In all cases, there is a gradual opening or closing of outlet 17, which leads to a reduction of the outlet pressure gradients and amplitudes, linked with a reduction of the overall noise. As a function of the port shape used and the opening time of the outlet cross-section on passing from curve V, linked with slight power losses, to curves VI, VII and VIII the filling level of the diagrams is considerably improved which, based on curve 5 corresponds to increased power accompanied by a noise reduction. The lower filling level of curves VI to VIII compared with the initial state Ib, all corresponding to the same power level, is compensated over the so-called time cross-section, i.e. the total opening time in the case of earlier opening and later closing.

The combined construction of intake 5, outlet 17, piston lower edge 14 and piston upper edge 19 adapted to one another as a function of the particular two-stroke internal combustion engine involved, permits a reduction of the dominant noise sources in full load and idling operation. This obviates the need for the otherwise necessary large-volume silencer, so that the overall constructional dimensions, which are dependent on the engine, as well as the weight of the chain saws can be reduced. As the main noise sources are eliminated, it is much easier to subsequently damp the remaining noise sources. The changes to the power characteristics of two-stroke internal combustion engines resulting from the construction 5 of intake and outlet 7 due to dynamic effects can be compensated by subsequent optimization of the port shapes for the engine type in question, such as further variation of the constructional parameters, adaptation of the scavenging channels for improved scavenging conditions and better cooling of the piston to such an extent that the power losses cannot be detected when operating the chain saws.

I claim:

1. A port-controlled two-stroke internal combustion engine with at least one cylinder having a longitudinal axis and constructed as a crankcase-scavenging pump, at least one intake duct leading into the crankcase interior in said cylinder and having an intake port, at least one outlet duct leading from said cylinder and having an outlet port, and scavenging ducts with overflow ports connected to said cylinder, wherein the intake port is formed by a rectangular section limited by an upper port edge and a lower port edge with an expansion section extending away from the lower port edge, and the outlet port is formed by a rectangular section limited by an upper port edge and a lower port edge with an expansion section extending away from the upper port edge, a piston located within said cylinder and being movable in the direction of the longitudinal axis of said cylinder in an upward stroke and downward stroke passing said intake port and said outlet port, said piston having an upper edge and a lower edge, characterized in that the intake port (5) and the outlet port (17) are constructed symmetrically in the direction of the longitudinal axis of the cylinder and are shaped in the region of the expansion so that during movement of the piston in the direction of the longitudinal axis due to the gradual release of the intake port (5) and the outlet port (17) the noise-generating intake and outlet pressure gradients and amplitudes are reduced, the expansion sections of said intake port and said outlet port each comprising a first section with converging sides extending outwardly from said lower port edge of said intake port and from said upper port edge of said outlet port, and a second section with parallel sides extending from said converging sides outwardly from said intake port and said outlet port, and each of said upper edge and said lower edge of said piston having a recess formed inwardly therein and located opposite and aligned with said expansion sections of said intake and outlet ports.

2. Two-stroke internal combustion engine according to claim 1, characterized in that the expansion section of said outlet port (17) has, at right angles to the longitudinal axis (18) of the cylinder, a homologous geometry to the expansion section of said inlet port (5).

3. Two-stroke internal combustion engine according to claim 1, characterized in that the recess (6) is constructed as a keyway (30) with a rectangular cross-section arranged on the piston edge.

4. Two-stroke internal combustion engine according to claim 1, characterized in that the recess is constructed as keyway (31) with a V-shaped cross-section arranged on the piston edge.

* * * * *